US010968025B2

(12) United States Patent
Wei

(10) Patent No.: US 10,968,025 B2
(45) Date of Patent: Apr. 6, 2021

(54) VACUUM CANISTER

(71) Applicant: THANKHOT BIOTECHNOLOGY CO., LTD., Guangdong (CN)

(72) Inventor: Honghua Wei, Guangdong (CN)

(73) Assignee: THANKHOT BIOTECHNOLOGY CO., LTD., Guangdong (CN)

( * ) Notice: Subject to any disclaimer, the term of this patent is extended or adjusted under 35 U.S.C. 154(b) by 55 days.

(21) Appl. No.: 16/607,586

(22) PCT Filed: Nov. 30, 2017

(86) PCT No.: PCT/CN2017/113809
§ 371 (c)(1),
(2) Date: Oct. 23, 2019

(87) PCT Pub. No.: WO2018/196375
PCT Pub. Date: Nov. 1, 2018

(65) Prior Publication Data

US 2020/0148447 A1 May 14, 2020

(30) Foreign Application Priority Data

Apr. 24, 2017 (CN) ..... 201710271189.1

(51) Int. Cl.
*B65D 81/20* (2006.01)

(52) U.S. Cl.
CPC ..... *B65D 81/2038* (2013.01)

(58) Field of Classification Search
CPC B65D 81/2038; B65D 51/16; B65D 51/1644; B65D 81/20; B65D 81/2015
(Continued)

(56) References Cited

U.S. PATENT DOCUMENTS 2,890,810 A * 6/1959 Rohling ..... B65D 51/1644 220/231
5,558,243 A * 9/1996 Chu ..... B65D 81/2038 215/228

(Continued)

FOREIGN PATENT DOCUMENTS

CN 201525559 U 7/2010
CN 201520041305 1/2015

(Continued)

OTHER PUBLICATIONS

International Search Report dated Jan. 24, 2018, in connection with PCT International Application No. PCT/CN2017113809.

(Continued)

*Primary Examiner* — Luan K Bui
(74) *Attorney, Agent, or Firm* — Norris McLaughlin, P.A.

(57) ABSTRACT

A vacuum canister includes a canister body and a cover body, wherein the cover body has a cover seat with an opening facing upwards, a through rod is disposed on a bottom wall of the cover seat, a valve seat is disposed at a lower opening end of the through rod, and a check valve is disposed on the valve seat. The cover seat is provided with an air extracting device including an inner barrel and an outer barrel. An opening end of the outer barrel is sleeved on the inner barrel. A through hole is axially opened in the inner barrel. The through rod passes through the through hole. The air extracting device includes a pressing handle sleeved on the outer barrel, wherein a lower end of the pressing handle abuts the push block. A limiting block is disposed on an outer circumferential wall of the pressing handle.

11 Claims, 7 Drawing Sheets

(58) Field of Classification Search
USPC ..... 206/524.8; 220/212, 231; 251/322, 323
See application file for complete search history.

(56) References Cited

U.S. PATENT DOCUMENTS

| | | | | |
|---|---|---|---|---|
| 8,936,169 | B2 * | 1/2015 | Lui | B65D 81/2015 220/212 |
| 9,725,224 | B2 | 8/2017 | Han | |
| 2003/0183657 | A1 * | 10/2003 | Chang | B65D 81/2038 222/383.1 |
| 2004/0155041 | A1 * | 8/2004 | Kwon | A47J 47/10 220/212 |
| 2013/0146500 | A1 * | 6/2013 | Kim | B65D 81/2038 206/524.8 |
| 2016/0167863 | A1 | 6/2016 | Han | |
| 2018/0222659 | A1 * | 8/2018 | Plazarte | B65D 81/2038 |

FOREIGN PATENT DOCUMENTS

| | | | |
|---|---|---|---|
| CN | 204999029 | U | 1/2016 |
| CN | 205366586 | U | 7/2016 |
| CN | 106043936 | A | 10/2016 |
| CN | 106865017 | A | 6/2017 |
| EP | 3 031 746 | A1 | 6/2016 |

OTHER PUBLICATIONS

Translation of International Search Report dated Jan. 24, 2018, in connection with PCT International Application No. PCT/CN2017113809.

* cited by examiner

VACUUM CANISTER

CROSS REFERENCE TO RELATED APPLICATION

This application claims benefit of Chinese Application Serial No. CN201710271189.1, filed Apr. 24, 2017, the contents of which are incorporated herein by reference in its entirety.

FIELD

The present disclosure relates to a storage container, and in particular, to a vacuum canister.

BACKGROUND

Canisters are common daily necessities and come with various types. A most common canister includes a canister body and a cover body. After food, medicine or the like is placed in the canister body, the cover body is covered to adequately isolate an article placed in the canister body from dust or the like. An existing canister can achieve adequate sealing performance and prevent air from entering, thus playing a certain role in keeping the article fresh. However, instead of being in a vacuum state, the article in the canister body is still exposed to air in the canister body and can only be preserved for a relatively short time.

A vacuum canister including a canister body and a canister cover is disclosed in the Chinese Patent No. CN201520041305.7. The canister cover includes an upper canister cover and a lower canister cover. An accommodating space is formed between the upper canister cover and the lower canister cover. An air outlet seat and an air inlet seat are disposed in the accommodating space. An air outlet hole is opened through the air outlet seat. An air inlet hole is opened through air inlet seat. A T-shaped sealing gasket is disposed in each of the air outlet hole and the air inlet hole. In the air outlet hole, a transverse side of the T-shaped sealing gasket abuts an upper surface of a first step of the air outlet hole. In the air inlet hole, a transverse side of the T-shaped sealing gasket abuts a lower surface of a second step of the air inlet hole. When the canister cover is pressed from an opening of the canister body towards the interior of the canister body, air within the canister body pushes up the transverse side of the T-shaped sealing gasket to be expelled from the air outlet hole. When air within the canister is expelled, the transverse side of the T-shaped sealing gasket is tightly attached to the surface of the air outlet seat. To take out food, the canister cover is pulled outwards to allow air to enter the canister body through the air inlet hole until the canister cover completely slides out from the canister body.

In such vacuum canister, both the air inlet seat and the air outlet seat need to be disposed on the canister body, leading to a complex structure. A push-pull rod is further disposed on the canister cover. The total length of the entire canister cover and the push-pull rod is almost equal to that of the canister body, and as a result it is inconvenient to carry such a vacuum canister. The canister cover is pressed into the canister body to expel air within the canister body. If a stored article has an irregular shape, air within the canister body cannot be completely expelled. Even if the article has a regular shape, air still remains in the air inlet hole and the air outlet hole, and a desired degree of vacuum cannot be ensured in the canister body. During the storage of liquid food such as soup and drink, the canister needs to be prevented from shaking, even less being put upside down, or otherwise liquid may flow out through the air inlet hole and the air outlet hole.

SUMMARY

Technical Problem

An objective of the present disclosure is to provide a vacuum canister, so as to improve the degree of vacuum and sealing performance of the vacuum canister.

Technical Solution

To achieve the foregoing objective, the vacuum canister provided in the present disclosure includes a canister body and a cover body, the cover body being disposed at an opening end of the canister body, wherein the cover body has a cover seat with an opening facing upwards, a through rod is disposed on a bottom wall of the cover seat, a valve seat is disposed at a lower opening end of the through rod, and a check valve is disposed on the valve seat. The cover seat is internally provided with an air extracting device which includes an inner barrel and an outer barrel, an opening end of the outer barrel faces downwards and is sleeved on the inner barrel, a through hole is axially opened in the inner barrel, the through rod passes through the through hole, a first seal ring is disposed between an outer circumferential wall of the through rod and the through hole, and a second seal ring is disposed between an inner circumferential wall of the outer barrel and an outer circumferential wall of the inner barrel. An annular mounting groove is disposed on the outer circumferential wall of the inner barrel, an air exhaust opening is opened in the mounting groove, the second seal ring is sleeved on the mounting groove, and the second seal ring can move up and down in a vertical direction of the mounting groove. A push block is provided at a lower end of the inner barrel. A spring is disposed between the inner barrel and the cover seat, one end of the spring abuts the inner barrel, and the other end of the spring abuts the cover seat. The air extracting device further includes a pressing handle, the pressing handle is sleeved on the outer barrel, and a lower end portion of the pressing handle abuts the push block. A limiting portion is disposed on a side wall of the cover seat, a limiting block is disposed on an outer circumferential wall of the pressing handle, and the limiting block can abut the limiting portion.

In an embodiment, the check valve includes an annular seat and a valve membrane extending upwards along the seat, the valve membrane is a hollow tapered body with an opening at one end, a horizontal top surface is disposed at a closed end of the valve membrane, a slit is opened in the top surface of the valve membrane, the seat is mounted on the valve seat, and the valve membrane faces upwards.

In another embodiment, the check valve includes an annular seat and a valve membrane extending upwards along the seat, the valve membrane is a hollow columnar body with an opening at one end, a slit is opened at a closed end of the valve membrane, the seat is mounted on the valve seat, and the valve membrane faces upwards.

In still another embodiment, the check valve is integrally formed of a silicone material.

In still another embodiment, the inner barrel includes an upper cover and a lower cover, the upper cover is fixed on the lower cover, the mounting groove is disposed on an upper outer circumferential wall of the lower cover, an outer edge of the upper cover is located at an upper end of the mounting groove, and the air exhaust opening is disposed on a lower surface of the mounting groove; and the push block is disposed on a lower outer circumferential wall of the lower cover, the push block is a convex block extending outwards from the lower outer circumferential wall of the lower cover, a plurality of penetrating holes are opened in the surface of the push block, a plurality of support columns are correspondingly disposed at a lower end portion of the outer barrel, and the support columns pass through the penetrating holes and abut the cover seat.

In still another embodiment, a first circular ring extending downwards from an upper surface of the upper cover is disposed at the middle of the upper cover, a second circular ring extending downwards from an upper surface of the lower cover is disposed at the middle of the lower cover, and the first circular ring is sleeved on the second circular ring.

In still another embodiment, a sleeve ring is disposed on a bottom wall of the outer barrel, an upper end portion of the through rod is fixedly sleeved in the sleeve ring, a first notch is provided at the upper end portion of the through rod, and a second notch is provided on the sleeve ring corresponding to the first notch.

In still another embodiment, an air inlet button and a vacuum indication button are further disposed on the cover body.

In still another embodiment, a buckle is further disposed on a side wall of the cover body, a hooking portion is disposed on the buckle, and a hooking block fitting the hooking portion is disposed on a side wall of the canister body.

In still another embodiment, a spring mounting seat is disposed on the bottom wall of the cover seat, the spring mounting seat includes an annular protrusion extending upwards from the bottom wall of the cover seat, and the annular protrusion and the through rod are coaxial.

Beneficial Effects of the Present Disclosure

In the vacuum canister provided in the present disclosure, the air extracting device is disposed in the cover seat. Air within the canister body is extracted when the pressing handle is pressed. The extracted air is expelled when the pressing handle is reset under the effect of the spring. A high vacuum environment can be obtained by means of such a working principle. In addition, the air extracting device is disposed on the cover body, thereby providing a compact structure and great portability.

In addition, the check valve is made of a silicone material. The silicone material is adequately elastic. Therefore, regardless of whether the valve membrane of the check valve is a tapered body or a columnar body. The slit has adequate self-sealing performance, so as to provide sealing against air and prevent liquid from leaking when the vacuum canister is put upside down, so that adequate sealing performance is implemented.

In addition, the inner barrel is provided with the upper cover and the lower cover to facilitate the mounting of the first seal ring and the second seal ring and simplify the manufacturing process.

In addition, the air inlet button is pressed to enable air to enter the canister body through the air inlet button to release a vacuum environment, making it easy to open the cover body. The vacuum in the canister body may be known from the vacuum indication button.

In addition, the buckle is disposed on the cover body to improve the sealing between the cover body and the canister body. The buckle is disposed on the cover body instead of the canister body to facilitate cleaning of the canister body.

The present disclosure is further described below with reference to the accompanying drawings and embodiments.

DETAILED DESCRIPTION

In the present disclosure, the structure of a cover body of a vacuum canister is mainly improved. The effectiveness of vacuumization of the cover body is improved, the sealing performance of the cover body is improved, and liquid is prevented from entering the cover body when a canister body is put upside down, and the vacuum canister becomes more portable and beautiful.

Figure 1:
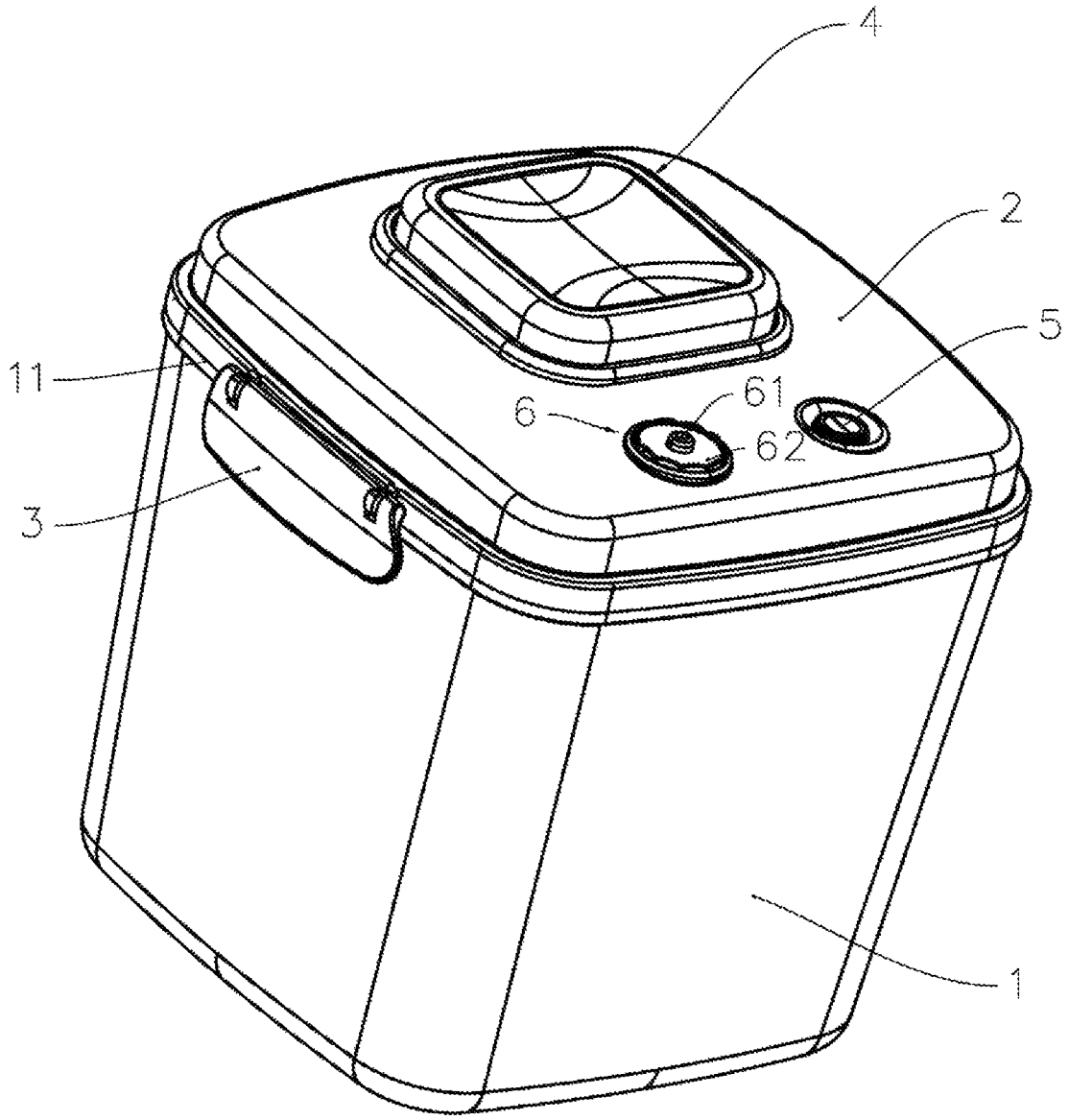
FIG. 1 is a structural view of an embodiment of a vacuum canister according to the present disclosure.

Referring to FIG. 1, which is a structural view of an embodiment of a vacuum canister according to the present disclosure. The vacuum canister includes a canister body 1 and a cover body 2. The cover body 2 is disposed at an opening end of the canister body 1. A buckle 3 is disposed on a side wall of the cover body 2. The buckle 3 is hinged on the cover body 2. Another buckle (not shown) is further disposed on another side, opposite a side wall provided with the buckle 3, of the cover body 2. A hooking portion (not shown) is disposed on the buckle 3. A hooking block 11 fitting the hooking portion is disposed on a side wall of the canister body 1. The buckle 3 and the other buckle securely lock the cover body 2 on the canister body 1. A vacuumizing device 4, an air inlet button 5, and a vacuum indication button 6 are disposed on the cover body 2. The vacuumizing device 4 may create a vacuum in the canister body 1. When the air inlet button 5 is pressed, air can enter the canister body 1 to release a vacuum state in the canister body 1, making it easy to open the cover body 2. The vacuum indication button 6 can show whether there is a vacuum state in the canister body 1 and can record the date on which an article is placed in the vacuum canister. When a convex point 61 in the middle of the vacuum indication button 6 is lowered, there is a vacuum state in the canister body 1. When the convex point 61 rises, there is a non-vacuum state in the canister body 1. Dates are circumferentially marked on a circular disk 62 of the vacuum indication button 6, and the circular disk 62 is rotated to the current date to record the date on which an article is placed.

Figure 2:
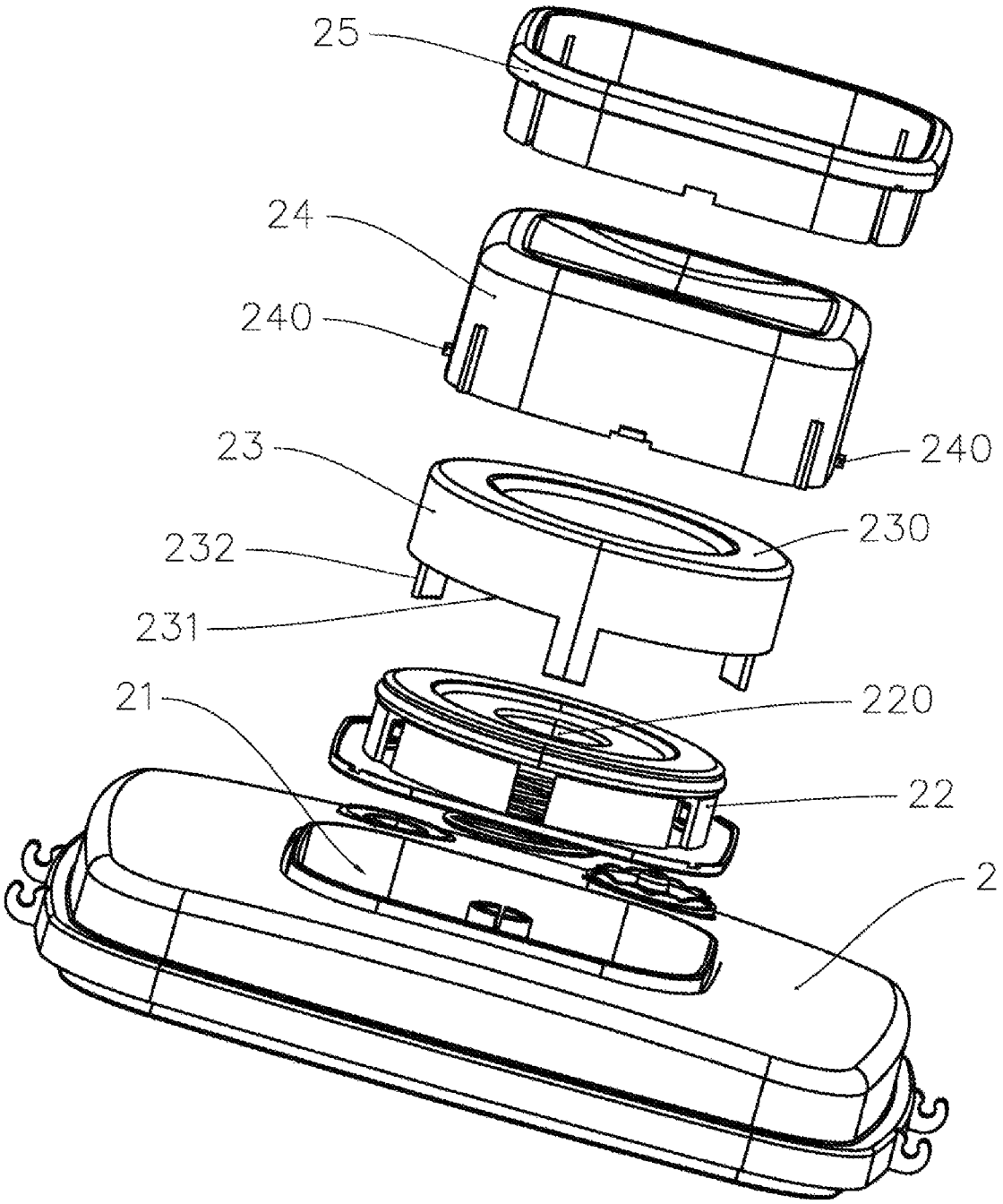
FIG. 2 is an exploded view of a cover body of an embodiment of a vacuum canister according to the present disclosure.

Referring to FIG. 2, which is an exploded view of the cover body 2. The cover body 2 has a cover seat 21 with an opening facing upwards. An air extracting device is disposed within the cover seat 21. The air extracting device includes an inner barrel 22, an outer barrel 23, and a pressing handle 24. A limiting portion 25 is disposed at an upper outer edge of the cover seat 21. A through hole 220 is circumferentially opened in the inner barrel 22. A closed end 230 of the outer barrel 23 is disposed above, and an opening end 231 of the outer barrel 23 is disposed facing downwards. A plurality of support columns 232 are disposed on a circumferential wall at the end portion of the opening end 231. In this embodiment, three support columns 232 are disposed.

Figure 3:
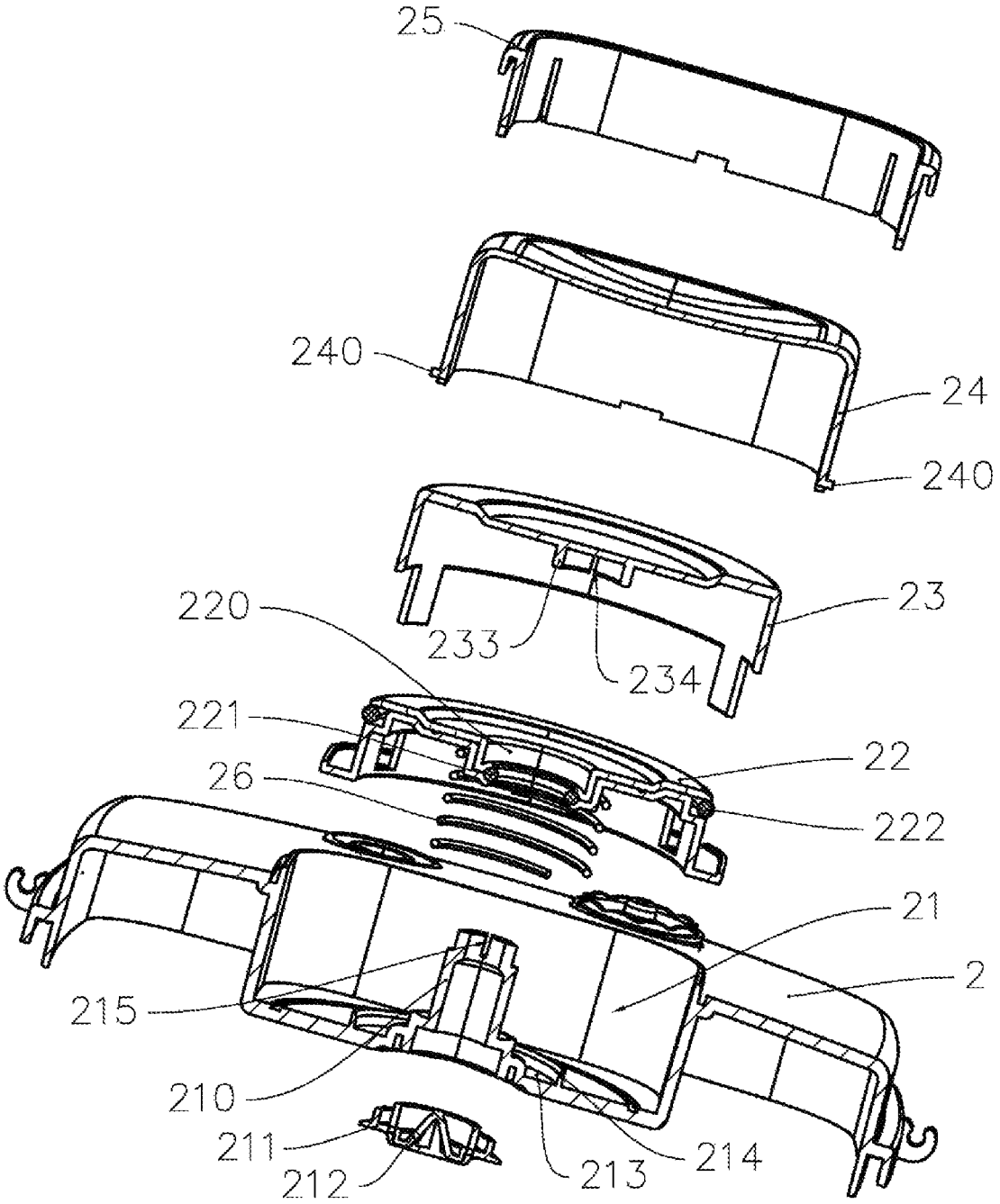
FIG. 3 is a sectional view of FIG. 2.

Referring to FIG. 3, which is a sectional view of FIG. 2, a through rod 210 is disposed on a bottom wall of the cover seat 21. A valve seat 211 is disposed at a lower opening end of the through rod 210. A check valve 212 is disposed on the valve seat 211. The check valve 212 provides one-way communication. That is, air within the canister body 1 may be expelled through the check valve 212, but air from outside cannot enter the canister body 1 through the check valve 212. A spring 26 is disposed between the inner barrel 22 and the cover seat 21. One end of the spring 26 abuts an inner bottom wall of the inner barrel 22, and the other end of the spring 26 abuts a spring mounting seat 213 on the cover seat 21. The spring mounting seat 213 includes an annular protrusion 214 extending upwards from the bottom wall of the cover seat 21. The annular protrusion 214 and the through rod 210 are coaxial. An annular groove formed between the annular protrusion 214 and the through rod 210 limits the spring 26. The through rod 210 penetrates the through hole 220 on the inner barrel 22. A first seal ring 221 is disposed between an outer circumferential wall of the through rod 210 and the through hole 220. A second seal ring 222 is disposed between an inner circumferential wall of the outer barrel 23 and an outer circumferential wall of the inner barrel 22. A sleeve ring 233 is disposed on a bottom wall of the outer barrel 23. An upper end portion of the through rod 210 is fixedly sleeved in the sleeve ring 233. A first notch 215 is provided at the upper end portion of the through rod 210. A second notch 234 is disposed on the sleeve ring 233 corresponding to the first notch 215. After the through rod 210 is sleeved on the sleeve ring 233, the first notch 215 is right opposite the second notch 234. A plurality of limiting blocks 240 are disposed at the bottom of an outer circumferential wall of the pressing handle 24. A lower end of the limiting portion 25 abuts the limiting block 240, so as to limit the displacement of the upward movement of the pressing handle 24 to prevent the pressing handle 24 from being ejected from the cover seat 21.

Figure 4:
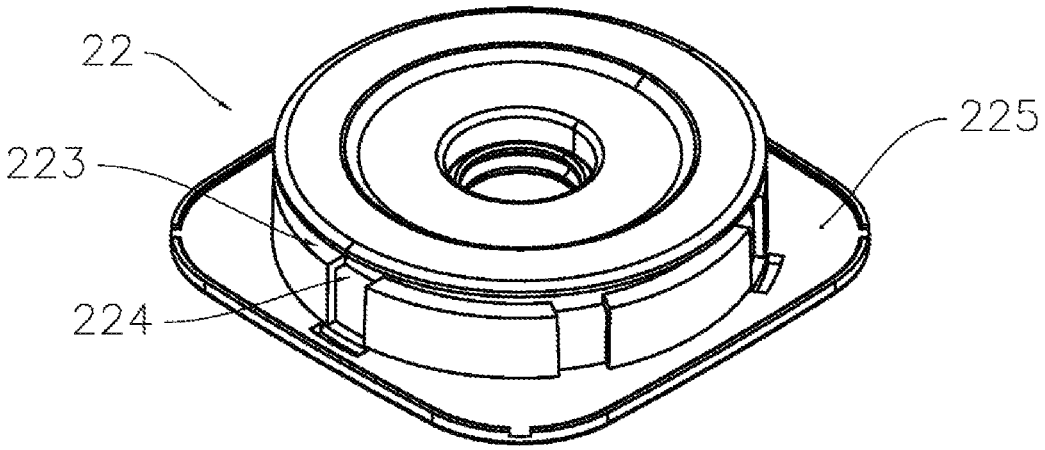
FIG. 4 is a structural view of an inner barrel of an embodiment of a vacuum canister according to the present disclosure.

Referring to FIG. 4, which is a structural view of the inner barrel. An annular mounting groove 223 is disposed on the outer circumferential wall of the inner barrel 22. The second seal ring 222 is sleeved on the mounting groove 223. In this embodiment, an air exhaust opening 224 is opened in a bottom wall of the mounting groove 223. In another implementation, the air exhaust opening may be disposed on a side wall of the mounting groove 223. A push block 225 is provided at a lower end of the inner barrel 22.

Figure 5:
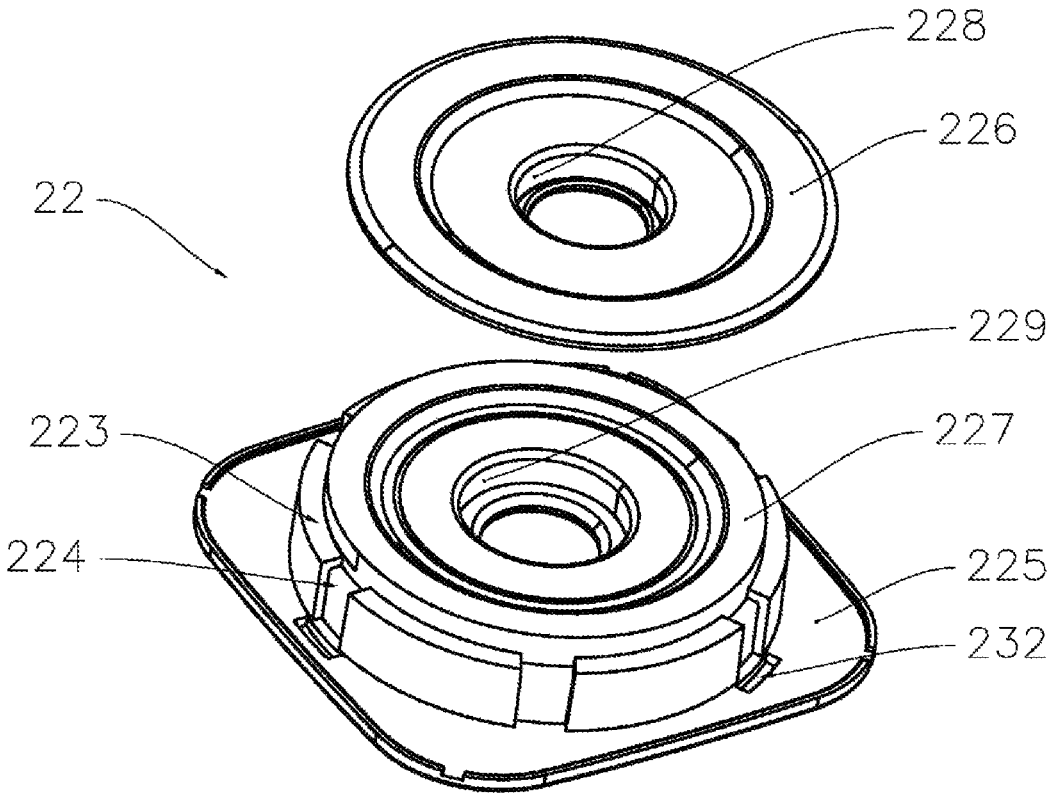
FIG. 5 is an exploded view of inner barrel of an embodiment of a vacuum canister according to the present disclosure.

Referring to FIG. 5, which is an exploded view of the inner barrel. The inner barrel 22 includes an upper cover 226 and a lower cover 227. A first circular ring 228 extending downwards from an upper surface of the upper cover 226 is disposed at the middle of the upper cover 226. A second circular ring 229 extending downwards from an upper surface of the lower cover 227 is disposed at the middle of the lower cover 227. The first circular ring 228 can be sleeved on the second circular ring 229. The mounting groove 223 is disposed on an upper outer circumferential wall of the lower cover 227. The upper cover 226 is sleeved on the lower cover 227. An outer edge of the upper cover 226 is located at an upper end of the mounting groove 223. The push block 225 is disposed on a lower outer circumferential wall of the lower cover 227. The push block 225 is a convex block extending outwards from the lower outer circumferential wall of the lower cover. The contour shape of the push block 225 corresponds to the contour shape of the inner circumferential wall of the cover seat 21. A plurality of penetrating holes 233 are opened in the surface of the push block 225. The support columns 232 on the outer barrel 23 pass through the penetrating holes 233 and abut the cover seat 21. The first seal ring 221 is mounted at the bottom of the second circular ring 227. After the second seal ring 222 is mounted in the mounting groove 223, the upper cover 226 is closed. The upper cover 226 and the lower cover 227 are fixed together by a bonding agent or fusion welding. The second seal ring 222 can move up and down in the mounting groove 223.

Figure 6:
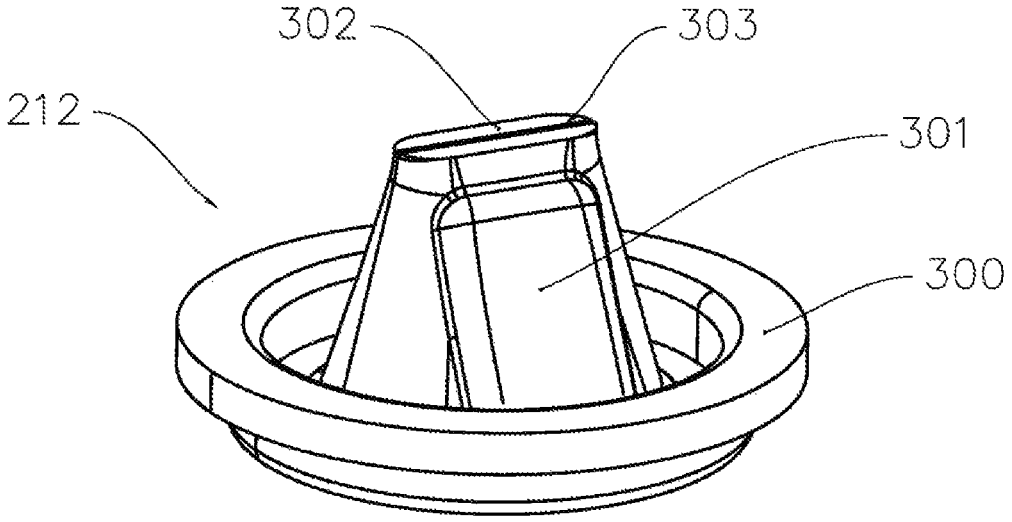
FIG. 6 is a structural view of Embodiment 1 of a check valve of an embodiment of a vacuum canister according to the present disclosure.
Figure 7:
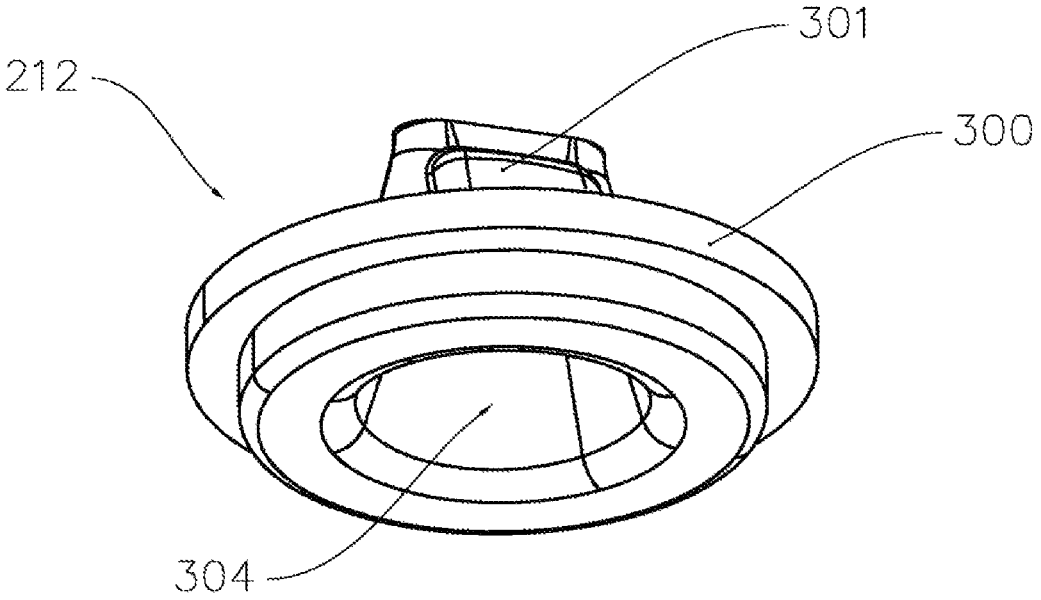
FIG. 7 is a structural view of Embodiment 1 of a check valve of an embodiment of a vacuum canister from another view angle according to the present disclosure.

Referring to FIG. 6 and FIG. 7, which are structural views of Embodiment 1 of the check valve from different view angles. In the structure in Embodiment 1 of the check valve, the check valve 212 includes an annular seat 300 and a valve membrane 301 extending upwards along the seat. The valve membrane 301 is a hollow tapered body with an opening at one end. An opening end 304 is disposed at the bottom of the valve membrane 301. A horizontal top surface 302 is disposed at a closed end of the valve membrane 301. A slit 303 is opened in the top surface 302 of the valve membrane 301. The check valve 212 is mounted on the valve seat 211 by the seat 300. The valve membrane 301 faces upwards. In the present disclosure, the tapered body is not a conical body, but is an approximately conical body. The "hollow" means that the valve membrane 301 is a structure hollow inside. The check valve 212 is integrally formed of a silicone material. The silicone material is adequately elastic. The slit 303 on the valve membrane 301 can be in a closed state when being in a natural state. Because the valve membrane 301 has the foregoing "self-closing" characteristic, when a liquid substance is filled in the canister body 1, if the entire vacuum canister is put upside down, the liquid does not flow out from the slit 303.

Figure 8:
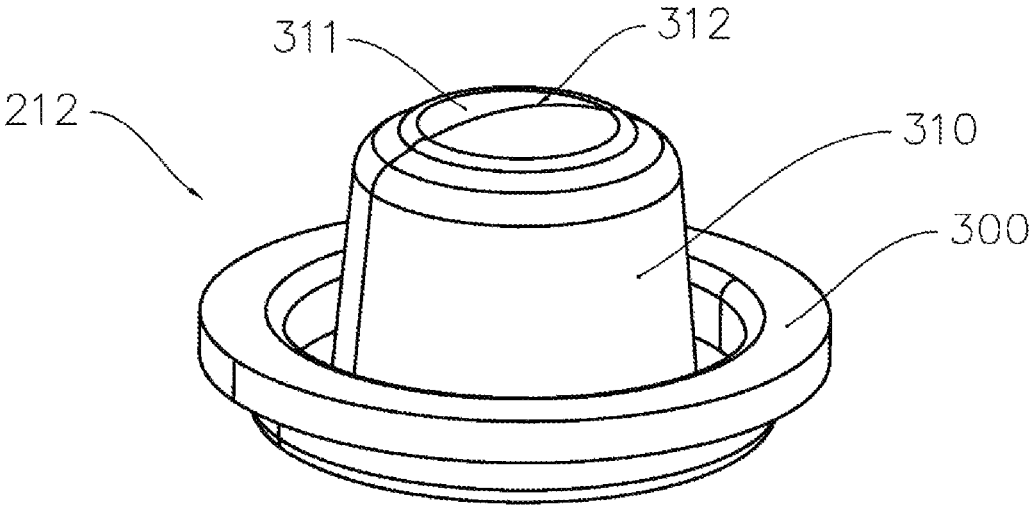
FIG. 8 is a structural view of Embodiment 2 of a check valve of an embodiment of a vacuum canister according to the present disclosure.
Figure 9:
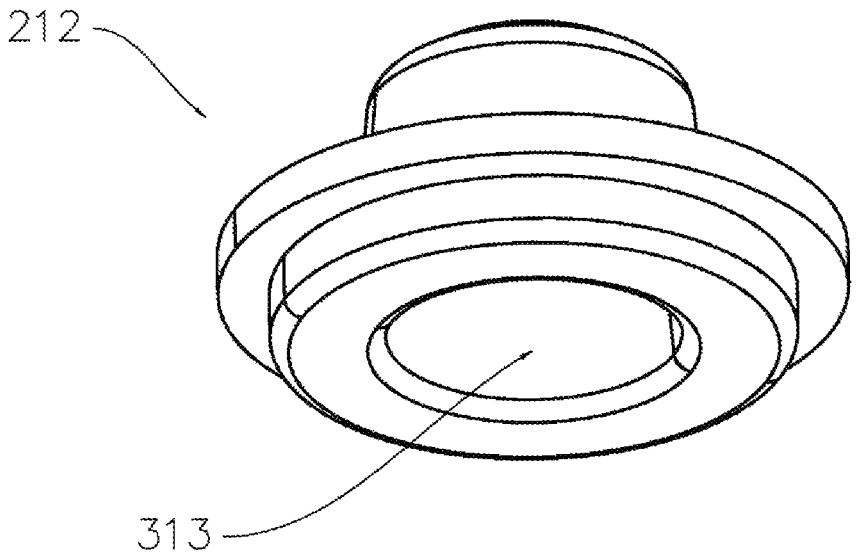
FIG. 9 is a structural view of Embodiment 2 of a check valve of an embodiment of a vacuum canister from another view angle according to the present disclosure.

Referring to FIG. 8 and FIG. 9, which are structural views of Embodiment 2 of a check valve from different view angles. In the structure of Embodiment 2 of the check valve, the check valve 212 includes an annular seat 300 and a valve membrane 310 extending upwards along the seat. The valve membrane 310 is a hollow columnar body with an opening at one end. An opening end 313 is disposed at the bottom of the valve membrane 310. A closed end 311 is disposed at the top of the valve membrane 310. A slit 312 is opened in the closed end 311. The check valve 212 is mounted on the valve seat 211 by the seat 300. The valve membrane 310 faces upwards. In the present disclosure, the columnar body is not an entirely cylindrical body, but is an approximately cylindrical body. The "hollow" means that the valve membrane 310 is a structure hollow inside. The check valve 212 is integrally formed of a silicone material. The silicone material is adequately elastic. The slit 312 on the valve membrane 310 is in a closed state when being in a natural state. Because the valve membrane 310 has the foregoing "self-closing" characteristic, when a liquid substance is filled in the canister body 1, if the entire vacuum canister is put upside down, the liquid does not flow out from the slit 312. The columnar valve membrane 310 in Embodiment 2 facilitates the backflow of a liquid better than the con-shaped valve membrane 301 in Embodiment 1.

Figure 10:
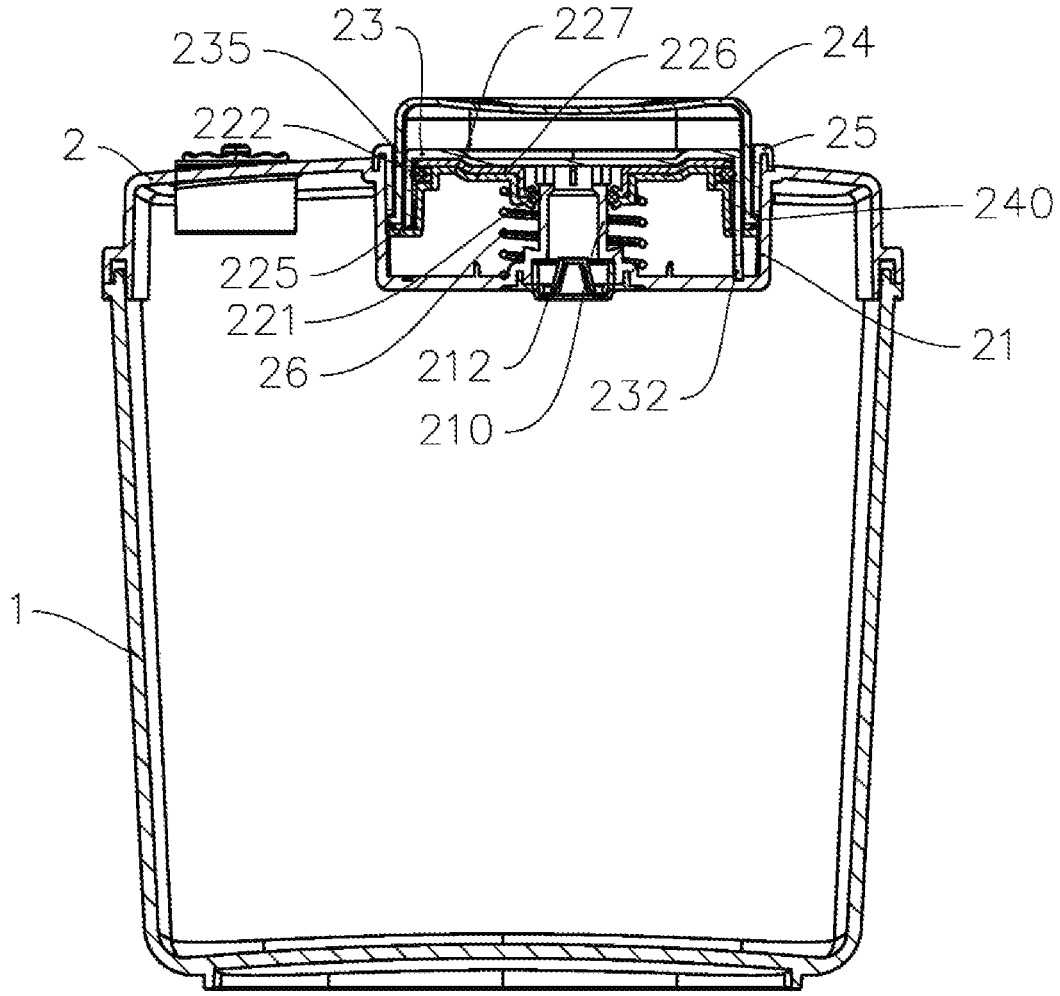
FIG. 10 is a sectional view of an embodiment of a vacuum canister according to the present disclosure.

Referring to FIG. 10, which is a sectional view of an embodiment of a vacuum canister according to the present disclosure. The working principle of the vacuum canister of the present disclosure is described below in detail with reference to FIG. 10.

When the pressing handle 24 is pushed downwards, a lower end of the pressing handle 24 abuts the push block 225 of the lower cover 227 of the inner barrel 22. The pressing handle 24 moves downwards to drive the inner barrel 22 to move downwards. The support columns 232 on the outer barrel 23 is clamped at the bottom wall of the cover seat 21 and is fixed. Therefore, friction occurs between the second seal ring 222 and an inner wall of the outer barrel 23 as the inner barrel 22 moves downwards. The second seal ring 222 is subject to an upward force of friction from the outer barrel 23, to enable the second seal ring 222 to be tightly attached on the upper cover 226. In this case, the second seal ring 222 seals a gap 235 between an outer edge of the upper cover 226 and the inner wall of the outer barrel 23. Air between the upper cover 226 and the outer barrel 23 and air outside are isolated. As the pressing handle 24 is pushed downwards, the inner barrel 22 moves downwards continuously. A space between the upper cover 226 and the outer barrel 23 continuously increases. In the sealed condition, the volume increases, and the pressure decreases, so that the pressure in the canister body 1 is greater than the pressure between the upper cover 226 and the outer barrel 23. Air within the canister body 1 pushes open the slit 303 or 312 in the check valve 212. The air within the canister body 1 enters the space between the upper cover 226 and the outer barrel 23 through the check valve 212 and the through rod 210. The pressure in the space between the upper cover 226 and the outer barrel 23 keeps growing. When the pressure in the space between the upper cover 226 and the outer barrel 23 becomes equal to the pressure in the canister body 1, the slit 303 or 312 on the check valve 212 automatically closes under the elastic effect of the valve membrane 301 or 310.

When the pressing handle 24 is pushed to the bottom, the pressing handle 24 is released. In this case, the spiral spring 26 is in a compressed state and moves upwards under the effect of the elastic restoring force of the spring 26 to drive the inner barrel 22 to move upwards and at the same time drive the pressing handle 24 to move upwards. As the second seal ring 222 moves upwards, under a downward force of friction from the outer barrel 23, the second seal ring 222 is tightly attached to a lower end of a mounting seat 223. In this case, the gap 235 is opened. The space between the upper cover 226 and the outer barrel 23 is in communication with the outside through the gap 235 and the air exhaust opening 224 in the mounting seat 223. As the inner barrel 22 moves upwards, before the limiting block 240 on the outer barrel 24 abuts the lower end of the limiting portion 25, the space between the upper cover 226 and the outer barrel 23 keeps being compressed, and air between the upper cover 226 and the outer barrel 23 is expelled.

The foregoing operations are repeated. Each time the pressing handle 24 is pressed, part of air within the canister body 1 is expelled. As air within the canister body 1 is continuously expelled, the degree of vacuum in the canister body 1 rises, and the pressing process becomes more difficult. After the pressing handle 24 has been repeatedly pressed, nearly all air within the canister body 1 is expelled. By means of the vacuum canister of the present disclosure, the air extracting device extracts air within the canister body 1 when the pressing handle 24 is pressed, and the extracted air is expelled when the pressing handle 24 is reset, so that a relatively high vacuum environment can be obtained in the vacuum canister, and the degree of vacuum of the vacuum canister is estimated by feeling the force of pressing. The vacuum in the canister body 1 is determined according to the vacuum indication button 6 (referring to FIG. 1).

In the vacuum canister of the present disclosure, when the pressing handle 24 is pressed, air within the canister body 1 is pumped into the vacuumizing device. When the pressing handle 24 is released, air in the vacuumizing device is expelled. As the spring restores, an air channel between the vacuumizing device and the outside is opened. The spring only needs to overcome the forces of friction between the first seal ring and the through rod and between the second seal ring and the outer barrel, but does need to overcome the high air pressure, Therefore, in the present disclosure, there is no high requirement for the spring, and the pressing is easy. A large force is needed for pressing only when there is a very high degree of vacuum in the canister body. The vacuum canister of the present disclosure can ensure a relatively high degree of vacuum in the canister body, and food, medicine or the like can be stored for a long time. The structure of the cover body is small and exquisite and does not need to occupy a very large space, thereby providing great portability. Both solid and liquid can be stored, and liquid do not leak if the vacuum canister is put upside down.

Certainly, the foregoing embodiments are only preferred implementation solutions of the present disclosure. More changes may be made during actual application. For example, the inner barrel returns to the original position via an air cylinder instead of the spring. Alternatively, a pressure sensor is disposed on a cup cover to detect the degree of vacuum in a cup body. Alternatively, for example, a side wall of the outer barrel abuts the bottom wall of the cover seat, a plurality of through grooves in the plumb direction are provided in the side wall of the outer barrel, a protrusion passing through the through groove is disposed at the lower cover of the inner barrel, and a lower end portion of the pressing handle abuts the protrusion. These changes may similarly achieve the same objectives of the present disclosure. Any modification, equivalent replacement, improvement, and the like made within the spirit and principle of the present disclosure should fall within the scope of protection of the present disclosure.

INDUSTRIAL APPLICABILITY

The vacuum canister of the present disclosure may be used as a storage box for keeping food, medicine, drink or the like fresh. The principle of a conventional vacuum canister is "press to expel air and reset to extract air". Different from this, the principle of the air extracting device of the present disclosure is "press to extract air and reset to expel air". To be specific, air within the canister body is extracted when the pressing handle is pressed, and the extracted air is expelled when the pressing handle is reset under the effect of a spring, thus obtaining a high vacuum environment in such a manner. When the degree of vacuum in the canister body is higher, a larger force is required to extract air. In the conventional manner of "reset to extract air", resetting is implemented by a restoring force of the spring, but the restoring force of the spring is limited. When the degree of vacuum in the canister body reaches a particular value, the restoring force of the spring is not sufficient to extract air. A pressure that a person can apply to the pressing handle is far greater than the restoring force of the spring. Therefore, the vacuum canister of the present disclosure can provide a relatively high vacuum environment, so that the storage time of an article is greatly extended and the freshness can be preserved more adequately. The air inlet button on the cover body may be used to release a vacuum environment in the canister body, making it easy to open the cover body. The vacuum in the canister body may be observed at any time by using the vacuum indication button on the cover body to extract air in time. The buckle is disposed between the cover body and the canister body, thereby improving the sealing between the cover body and the canister body. The buckle is disposed on the cover body instead of the canister body, so that the canister body can be conveniently cleaned.

The invention claimed is:

1. A vacuum canister, comprising a canister body and a cover body disposed at an opening end of the canister body, and having a cover seat with an opening facing upwards, wherein a through rod is disposed on a bottom wall of the cover seat, a valve seat is disposed at a lower opening end of the through rod, and a check valve is disposed on the valve seat, and wherein:

the check valve is internally provided with an air extracting device which comprises an inner barrel and an outer barrel, an opening end of the outer barrel faces downwards and is sleeved on the inner barrel, a through hole is axially opened in the inner barrel, the through rod passes through the through hole, a first seal ring is disposed between an outer circumferential wall of the through rod and the through hole, and a second seal ring is disposed between an inner circumferential wall of the outer barrel and an outer circumferential wall of the inner barrel;

an annular mounting groove is disposed on the outer circumferential wall of the inner barrel, an air exhaust opening is opened in the mounting groove, the second seal ring is sleeved on the mounting groove, and the second seal ring can move up and down in a vertical direction of the mounting groove;

a push block is provided at a lower end of the inner barrel; a spring is disposed between the inner barrel and the cover seat, one end of the spring abuts the inner barrel, and the other end of the spring abuts the cover seat;

the air extracting device further comprises a pressing handle, the pressing handle is sleeved on the outer barrel, and a lower end portion of the pressing handle abuts the push block; and a limiting portion is disposed on a side wall of the cover seat, a limiting block is disposed on an outer circumferential wall of the pressing handle, and the limiting block can abut the limiting portion.

2. The vacuum canister according to claim 1, wherein: the check valve comprises an annular seat and a valve membrane extending upwards along the seat, the valve membrane is a hollow tapered body with an opening at one end, a horizontal top surface is disposed at a closed end of the valve membrane, a slit is opened in the top surface of the valve membrane, the seat is mounted on the valve seat, and the valve membrane faces upwards.

3. The vacuum canister according to claim 1, wherein: the check valve comprises an annular seat and a valve membrane extending upwards along the seat, the valve membrane is a hollow columnar body with an opening at one end, a slit is opened at a closed end of the valve membrane, the seat is mounted on the valve seat, and the valve membrane faces upwards.

4. The vacuum canister according to claim 1, wherein: the check valve is integrally formed of a silicone material.

5. The vacuum canister according to claim 1, wherein: the inner barrel comprises an upper cover and a lower cover, the upper cover is fixed on the lower cover, the mounting groove is disposed on an upper outer circumferential wall of the lower cover, an outer edge of the upper cover is located at an upper end of the mounting groove, and the air exhaust opening is disposed on a lower surface of the mounting groove; and the push block is disposed on a lower outer circumferential wall of the lower cover, the push block is a convex block extending outwards from the lower outer circumferential wall of the lower cover, a plurality of penetrating holes are opened in the surface of the push block, a plurality of support columns are correspondingly disposed at a lower end portion of the outer barrel, and the support columns pass through the penetrating holes and abut the cover seat.

6. The vacuum canister according to claim 5, wherein: a first circular ring extending downwards from an upper surface of the upper cover is disposed at the middle of the upper cover, a second circular ring extending downwards from an upper surface of the lower cover is disposed at the middle of the lower cover, and the first circular ring is sleeved on the second circular ring.

7. The vacuum canister according to claim 1, wherein: a sleeve ring is disposed on a bottom wall of the outer barrel, an upper end portion of the through rod is fixedly sleeved in the sleeve ring, a first notch is provided at the upper end portion of the through rod, and a second notch is provided on the sleeve ring corresponding to the first notch.

8. The vacuum canister according to claim 1, wherein: an air inlet button and a vacuum indication button are further disposed on the cover body.

9. The vacuum canister according to claim 1, wherein: a buckle is further disposed on a side wall of the cover body, a hooking portion is disposed on the buckle, and a hooking block fitting the hooking portion is disposed on a side wall of the canister body.

10. The vacuum canister according to claim 1, wherein: a spring mounting seat is disposed on the bottom wall of the cover seat, the spring mounting seat comprises an annular protrusion extending upwards from the bottom wall of the cover seat, and the annular protrusion and the through rod are coaxial.

11. The vacuum canister according to claim 2, wherein: the check valve is integrally formed of a silicone material.

* * * * *